United States Patent [19]

Matsubara

[11] 4,007,918

[45] Feb. 15, 1977

[54] PREFABRICATED FENCE

[75] Inventor: Isamu Matsubara, Nyuzen, Japan

[73] Assignee: Yoshida Kogyo K.K., Tokyo, Japan

[22] Filed: Oct. 17, 1975

[21] Appl. No.: 623,508

[30] Foreign Application Priority Data

Oct. 17, 1974 Japan ..... 49-125578

[52] U.S. Cl. ..... 256/59

[51] Int. Cl.[2] ..... E04H 17/14

[58] Field of Search ..... 256/65, 59

[56] References Cited

UNITED STATES PATENTS

| | | | |
|---|---|---|---|
| 2,754,092 | 7/1956 | Cremens | 256/65 |
| 2,820,613 | 1/1958 | Schilling | 256/65 |

*Primary Examiner*—Werner H. Schroeder
*Assistant Examiner*—Doris L. Troutman
*Attorney, Agent, or Firm*—Hill, Gross, Simpson, Van Santen, Steadman, Chiara & Simpson

[57] ABSTRACT

Each of two or more posts fixedly mounted on a parapet or like stationary base structure terminates at its top end in a toprail holding portion. A top rail has its underside so shaped as to slide into the top-rail holding portions of the posts for interfitting engagement therewith when the top rail is moved longitudinally relative to the posts. The posts have aligned holes therethrough for receiving a bottom rail. A plurality of balusters for installation between the top and bottom rails also have their top and bottom ends shaped for interfitting engagement with the respective rails.

9 Claims, 8 Drawing Figures

PREFABRICATED FENCE

BACKGROUND OF THE INVENTION

1. Field of Invention

This invention relates to fences or balustrades, and in particular to a prefabricated fence for ready installation on a parapet or like stationary base structure for use, for example, as handrailing.

2. Prior Art

In the fence structures of the class and kind under consideration, it has heretofore been customary to secure the constituent members of a fence, such as posts, rails and balusters, to each other by means of screws. The use of screws, however, is disadvantageous in that it requires an additional manufacturing step of forming screw holes in the constituent fence members. The installation or assemblage of the conventional fence is also highly troublesome because of the frequent screwing operations required, and the completed fence is unsatisfactory in terms of strength.

SUMMARY OF THE INVENTION

A principal object of this invention resides in the provision of a prefabricated fence which can be readily installed or assembled with minimum use of screws or like fastener elements but which, nevertheless, has sufficient strength in use.

With this and other objects in view this invention provides a prefabricated fence including at least two posts which are adapted to be fixedly mounted in spaced positions on a parapet or like base structure and each of which has a top-rail holding portion at its top end and a hole extending horizontally therethrough at a point adjacent its bottom end. A top rail of uniform cross-sectional shape throughout its length has its underside shaped for interfitting engagement with the top-rail holding portions of the posts, in such a way that the top rail underside can be slid into the top-rail holding portions when moved in its longitudinal direction relative to the posts. A bottom rail, which can also be of uniform cross-sectional shape throughout its length, is inserted securely into the holes in the posts. To be installed in parallel spaced relationship between the top and bottom rails are a plurality of balusters each having at its top end a top-rail holding portion which is at least partly identical in shape and size with the aforesaid top-rail holding portion of each post and which is therefore capable of interfitting engagement with the underside of the top rail. Each baluster terminates at its bottom end in a bottom-rail holding portion which is adapted to fit over the bottom rail.

As may have been noted from the foregoing summary, the prefabricated fence according to this invention comprises interfitting parts which can be speedily assembled with minimum use of fastener elements. The thus-assembled fence has high strength and is pleasing in appearance.

The features which are believed to be novel and characteristic of this invention are set forth in particular in the appended claims. The invention itself, however, both as to its configuration and manner of assemblage, together with the additional objects and advantages thereof, will be best understood from the following description taken in connection with the accompanying drawings in which like reference characters refer to like parts throughout the several views.

DESCRIPTION OF THE PREFERRED EMBODIMENTS

Figure 1:
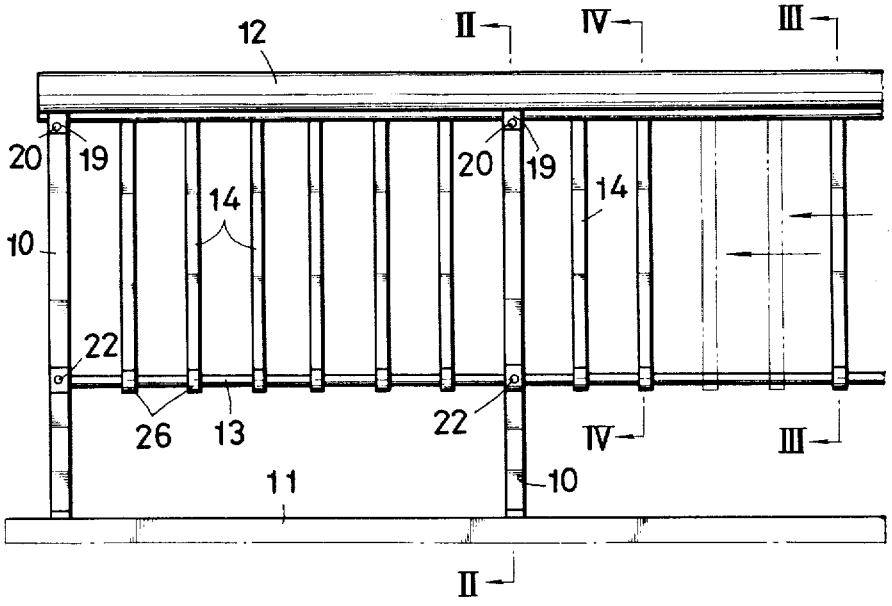
FIG. 1 is a partial front elevational view of a preferred form of the prefabricated fence according to this invention, the view being also explanatory of the manner of assemblage of the fence.

With particular reference to FIG. 1, the preferred form of the prefabricated fence according to the invention broadly comprises two or more posts 10 for installation on a parapet or like stationary base structure 11, a pair of top and bottom rails 12 and 13 supported horizontally by the posts in parallel spaced relationship, and a plurality of spaced balusters 14 between the top and bottom rails.

Figure 2:
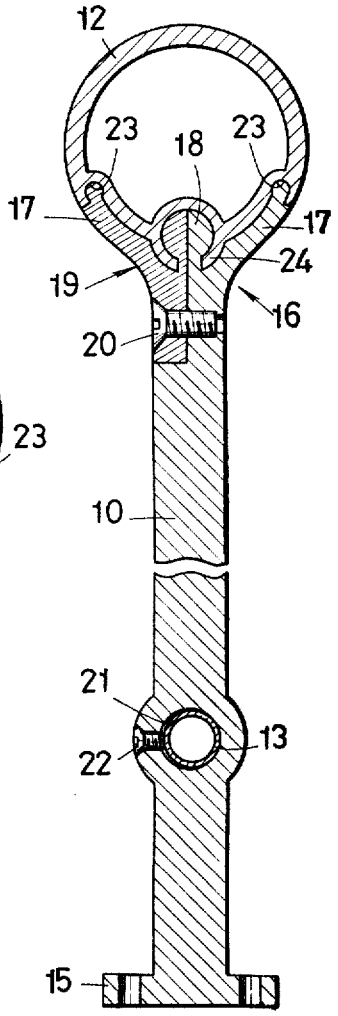
FIG. 2 is an enlarged, partly-broken-away cross-sectional view taken along line II—II in FIG. 1.

As illustrated in greater detail in FIG. 2, each post 10 has a pedestal 15 which can be conveniently affixed to the base structure 11. The post 10 terminates at its top end in a top-rail holding portion generally designated 16 in FIG. 2. In this particular embodiment of the invention, the top-rail holding portion 16 includes a pair of upwardly diverging fins or arms 17 and a tongue 18 of circular cross section disposed centrally between the fins.

In order to assure firm attachment of the top rail 12 to the posts 10, a part of the top-rail holding portion 16 of each post is preferably constituted of a separate filler member 19. This filler member can be secured to the post by means of a countersunk machine screw 20 or like fastener element, as described below in more detail.

Each post 10 further has a hole 21 extending horizontally therethrough at a point adjacent its bottom end. These holes of the posts 10 receive the bottom rail 13, which is shown to be of hollow, circular cross-sectional shape throughout its length. A countersunk machine screw 22 may be used to fasten the bottom rail 13 to each post 10.

The top rail 12, which also is of uniform cross-sectional shape throughout its length, has its underside shaped in conformity with the top-rail holding portion 16 of each post 10 for interfitting engagement therewith. More specifically, the underside of the top rail 12 is shaped to provide a pair of grooves 23 for receiving the respective fins 17 on each post 10 and a pair of jaws 24 for gripping engagement of the tongue 18 on each post.

Figure 3:
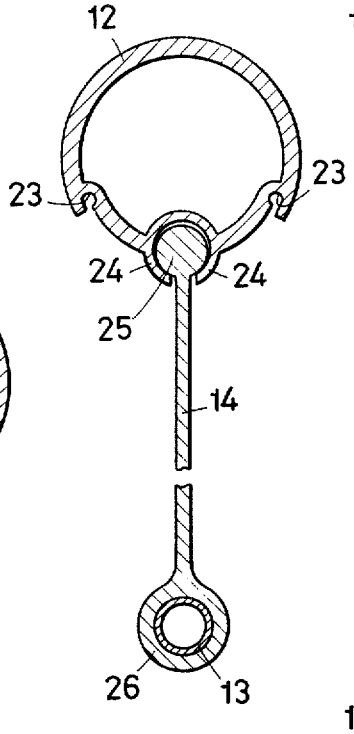
FIG. 3 is an enlarged, partly-broken-away cross-sectional view taken along line III—III in FIG. 1.

As best shown in FIG. 3, each of the balusters 14 has its top end shaped into a top-rail holding portion 25 which is at least partly identical in shape and size with the top-rail holding portion 16 of each post 10. In one form of construction the top-rail holding portion 25 of each baluster 14 takes the shape of a cylindrical head, as shown, which is externally identical with the tongue 18 on each post 10 and which therefore can be engaged in the gripping jaws 24 on the underside of the top rail 12.

Each baluster 14 has at its bottom end a bottom-rail holding portion 26 which fits over the bottom rail 13. In this particular embodiment of the invention, the bottom-rail holding portion 26 is shown to be a ring capable of receiving the bottom rail 13.

For the installation or assemblage of the complete fence, the post 10 may first be mounted on the base structure 11. The underside of the top rail 12 is then slid into the top-rail holding portion 16 of the post 10, exclusive of the filler member 19, by moving the top rail in its longitudinal direction relative to the post. The filler member 19 is succeedingly guided along the top rail 12 into one of its grooves 23 and its jaws 24, thereby affording firm attachment of the top rail 12 to the post 10. The filler member 19 is then fastened to the post 10 as by the screw 20.

One end of the bottom rail 13 is then inserted into the hole 21 in the post 10. This bottom rail is likewise fastened to the post as by the screw 22.

Thereafter the balusters 14 are successively installed in spaced-apart positions between the top and bottom rails 12 and 13, each by having its top-rail holding portion 25 engaged in the gripping jaws 24 of the top rail and by having its bottom-rail holding portion 26 fitted over the bottom rail. In order to restrain the balusters 14 from displacement along the top and bottom rails 12 and 13, a force may be applied to the underside of the bottom-rail holding portion 26 of each baluster to indent the same with the bottom rail passing therethrough, as indicated at 27 in FIG. 4.

The next post 10 is then mounted in position on the base structure 11. Additional balusters 14 may be installed between the top and bottom rails 12 and 13 in the above described manner. The prefabricated fence according to this invention can thus be assembled to a desired horizontal length.

Figure 4:
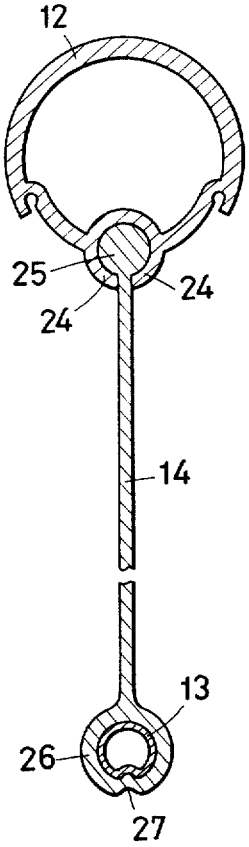
FIG. 4 is an enlarged, partly-broken-away cross-sectional view taken along line IV—IV in FIG. 1.

Alternatively, a suitable number of balusters 14 may first be installed between the top and bottom rails 12 and 13 on a tentative basis. The rails 12 and 13 complete with the balusters 14 may then be installed to the posts 10. The balusters 14 may be locked against displacement as shown in FIG. 4 after being neatly rearranged in predetermined spaced-apart positions between the rails 12 and 13.

Figures 5A, 5B, 6A, 6B:
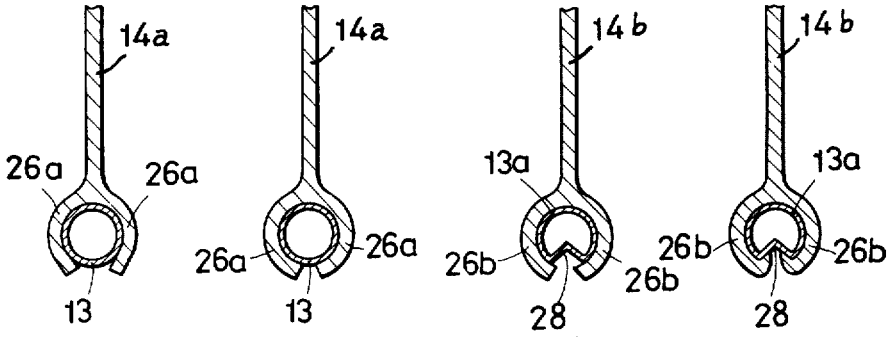
FIGS. 5A and 5B are partial, vertical cross-sectional views somewhat similar to FIGS. 3 and 4 but showing a different example of means for securing each baluster to the bottom rail in the fence of FIG. 1.
FIGS. 6A and 6B are views similar to FIGS. 5A and 5B but showing a further different example of means for securing each baluster to the bottom rail in the fence of FIG. 1.

FIGS. 5A and 5B illustrate a different example of the bottom-rail holding portion at the bottom end of each baluster 14. As shown in FIG. 5A, the baluster 14*a* terminates at its bottom end in a pair of jaws 26*a* adapted for gripping engagement of the bottom rail 13. After installation of the balusters 14*a* in position between the top and bottom rails 12 and 13, the gripping jaws 26*a* of each baluster can be compressed or pressed toward each other over the bottom rail, as shown in FIG. 5B, thereby restraining the baluster from displacement.

In FIGS. 6A and 6B each baluster 14*b* is shown to have at its bottom end a pair of gripping jaws 26*b* similar to the jaws 26*a* of FIGS. 5A and 5B. These gripping jaws 26*b* are for use with a bottom rail 13*a* having an inverted-V-shaped groove 28 extending longitudinally on its underside. Thus, after installation of the balusters 14*b* in position between the top and bottom rails 12 and 13, the gripping jaws 26*b* of each baluster may be clinched so that the opposed edges of the jaws will be engaged in the groove 28 on the bottom rail.

With the invention thus fully disclosed, it is clear that the objects as above stated have been attained in a simple and thoroughly practicable manner. While some particular embodiments of the invention have been shown and described, it is to be understood that changes may be made in the construction and arrangements of the various parts without departing from the scope of the invention as expressed in the following claims.

What is claimed is:

1. A prefabricated fence for installation on a parapet or like stationary base structure, comprising in combination:

a. at least two posts having means by which they can be fixedly mounted in spaced-apart positions on the base structure, each of said posts having its upper end shaped as a top-rail holding portion and having a hole extending horizontally through each said post at a point adjacent to its lower end;

b. a top rail having a uniform cross-sectional shape throughout its length, said top rail having its underside shaped in conformity with said top-rail holding portion of each said post, the underside of said top rail having a sliding fit with said top-rail holding portions of said posts in a longitudinal direction;

c. a bottom rail of uniform original cross-sectional shape throughout its length, said bottom rail extending through said holes of said posts; and d. a plurality of balusters each having at its upper end a top-rail holding portion which is at least partially identical in cross-sectional shape and size with said top-rail holding portion of each said post, and having interfitting engagement with the underside of said top rail, each said baluster having at its lower end a bottom-rail holding portion fitting over said bottom rail.

2. A prefabricated fence as set forth in claim 1, wherein a part of said top-rail holding portion of each said post comprises a separate filler element having interfitting engagement with a corresponding part of the underside of said top-rail.

3. A prefabricated fence as set forth in claim 2, wherein said interfitted filler member is secured to each said post by means of a fastener element.

4. A prefabricated fence as set forth in claim 1, wherein said top-rail holding portion of each said post includes a pair of upwardly diverging fins and a tongue arranged therebetween.

5. A prefabricated fence as set forth in claim 4, wherein said top-rail holding portion of each said baluster is identical in shape and size with said tongue on each said post.

6. A prefabricated fence as set forth in claim 1, wherein said bottom rail is circular in cross-sectional shape, and wherein said bottom-rail holding portion of each said baluster is in the form of a ring receiving said bottom rail therethrough.

7. A prefabricated fence according to claim 6, each said baluster being secured to said bottom rail by an indentation in said ring at a point where said bottom rail passes therethrough.

8. A prefabricated fence according to claim 1, said bottom-rail holding portion of each said baluster including a pair of jaws in gripping engagement with said bottom rail, and each said baluster being secured to said bottom rail by said jaws' having been compressed over said bottom rail.

9. A prefabricated fence according to claim 1, said bottom rail having a groove formed longitudinally thereon, said bottom-rail holding portion of each said baluster including a pair of jaws in gripping engagement with said bottom rail, and each said baluster being secured to said bottom rail by said jaws' having been so clinched that the opposed edges thereof engage in said groove on said bottom rail.

* * * * *